US011233350B2

(12) United States Patent
Shimizu

(10) Patent No.: US 11,233,350 B2
(45) Date of Patent: Jan. 25, 2022

(54) CONNECTOR WITH SPRING HAVING RESILIENT PIECES THAT SANDWICH A MATING TERMINAL AND A HOUSING THAT HOLDS THE SPRING

(71) Applicants: AutoNetworks Technologies, Ltd., Mie (JP); Sumitomo Wiring Systems, Ltd., Mie (JP); SUMITOMO ELECTRIC INDUSTRIES, LTD., Osaka (JP)

(72) Inventor: Toru Shimizu, Mie (JP)

(73) Assignees: AutoNetworks Technologies, Ltd.; Sumitomo Wiring Systems, Ltd.; Sumitomo Electric Industries, Ltd.

( * ) Notice: Subject to any disclaimer, the term of this patent is extended or adjusted under 35 U.S.C. 154(b) by 0 days.

(21) Appl. No.: 16/971,289

(22) PCT Filed: Jan. 9, 2019

(86) PCT No.: PCT/JP2019/000372
§ 371 (c)(1),
(2) Date: Aug. 19, 2020

(87) PCT Pub. No.: WO2019/167434
PCT Pub. Date: Sep. 6, 2019

(65) Prior Publication Data

US 2020/0395703 A1 Dec. 17, 2020

(30) Foreign Application Priority Data

Feb. 27, 2018 (JP) ..... JP2018-033421

(51) Int. Cl.
*H01R 13/02* (2006.01)
*H01R 13/187* (2006.01)
(Continued)

(52) U.S. Cl.
CPC ..... *H01R 13/187* (2013.01); *H01R 13/04* (2013.01); *H01R 13/11* (2013.01); *H01R 13/516* (2013.01)

(58) Field of Classification Search
CPC ..... H01R 13/187; H01R 13/20; H01R 13/15; H01R 13/10; H01R 13/02; H01R 13/04;
(Continued)

(56) References Cited

U.S. PATENT DOCUMENTS 3,659,243 A 4/1972 Gluntz
6,551,143 B2 * 4/2003 Tanaka ..... H01R 12/7088 439/682
(Continued)

FOREIGN PATENT DOCUMENTS

JP 49-33223 9/1974
JP 2012-508959 4/2012
(Continued)

OTHER PUBLICATIONS

International Search Report dated Mar. 5, 2019.

*Primary Examiner* — Harshad C Patel
(74) *Attorney, Agent, or Firm* — Gerald E. Hespos; Michael J. Porco; Matthew T. Hespos

(57) ABSTRACT

A connector (10) is provided into which a plate-like mating terminal (100) is insertable. The connector (10) has a plate-like connection terminal (20), a spring (80), and a housing (40) including an insertion opening into which the mating terminal (100) is inserted. The spring (80) is held in the housing (40). The mating terminal (100) inserted into the insertion opening and the connection terminal (20) are sandwiched by the spring (80).

12 Claims, 13 Drawing Sheets

(51) Int. Cl.
*H01R 13/04* (2006.01)
*H01R 13/11* (2006.01)
*H01R 13/516* (2006.01)

(58) Field of Classification Search
CPC .... H01R 13/005; H01R 13/11; H01R 13/516; H01R 13/514; H01R 13/46
USPC ..... 439/625, 856, 851, 853, 854, 855, 578, 439/345, 346, 362, 364, 619, 660, 678, 439/699.1, 708, 723, 290, 607.01, 850, 439/852
See application file for complete search history.

(56) References Cited

U.S. PATENT DOCUMENTS 7,845,993 B2 * 12/2010 Falchetti ..... H01R 13/18 439/843
8,128,441 B2 * 3/2012 Mukuno ..... H01R 13/055 439/845
8,827,754 B2 * 9/2014 Lee ..... H01R 13/187 439/845
10,177,489 B1 * 1/2019 Aoshima ..... H01R 13/631
10,230,191 B2 * 3/2019 Lui ..... H01R 43/16
10,290,965 B1 * 5/2019 Morello ..... H01R 13/11
2003/0060090 A1 * 3/2003 Allgood ..... H01R 11/289 439/845
2010/0124857 A1 * 5/2010 Kawamura ..... H01R 13/18 439/816
2010/0151748 A1 * 6/2010 Kato ..... H01R 13/113 439/834
2011/0045712 A1 * 2/2011 Mukuno ..... H01R 4/4881 439/845
2012/0156947 A1 * 6/2012 Tyler ..... H01R 13/113 439/842
2016/0190726 A1 6/2016 Kamei

FOREIGN PATENT DOCUMENTS

JP 2014-220188 11/2014
JP 2016-122623 7/2016
JP 6222039 10/2017

* cited by examiner

CONNECTOR WITH SPRING HAVING RESILIENT PIECES THAT SANDWICH A MATING TERMINAL AND A HOUSING THAT HOLDS THE SPRING

BACKGROUND

Field of the Invention

This specification relates to a connector.

Related Art

Japanese Patent No. 6222039 discloses a female terminal to be connected to a male terminal. This female terminal includes a rectangular tubular fitting formed by peripheral walls and a resilient piece disposed in the fitting resiliently contact the male terminal. The male terminal is connected conductively to the female terminal by being sandwiched between the resilient piece and the peripheral wall facing the resilient piece. The female terminal is formed into a rectangular tube shape by stamping and bending a plate-like metal material by press-working.

However, if a plate thickness of a metal material is increased due to a larger current, it may become impossible to manufacture a female terminal in the form of a rectangular tube by press-working.

SUMMARY

A connector disclosed by this specification has a housing with a plate-like connection terminal and a spring held in the housing. The housing includes an insertion opening into which a plate-like mating terminal is inserted so that the spring sandwiches the mating terminal and the connection terminal.

According to this configuration, the terminal need not be processed into a tubular shape so that the plate-like terminal can be used. Therefore, the terminal can be manufactured easily even if a plate thickness of the terminal increases.

The connection terminal may include a contact projecting on a surface facing the mating terminal. The contact may have a spherical contact surface. Thus, a contact area of the mating terminal and the contact surface of the connection terminal will not suddenly decrease even if the mating terminal is twisted. Therefore, a sudden increase of contact resistance between the mating terminal and the connection terminal can be suppressed.

The spring may include a first pressing portion for pressing the mating terminal toward the connection terminal and a second pressing portion for pressing the connection terminal toward the mating terminal. The mating terminal inserted into the insertion opening and the connection terminal may be sandwiched by the first and second pressing portions. Therefore, the connection terminal and the mating terminal are in contact at a high contact pressure and are connected electrically.

The spring may be a leaf spring made metal a plate-like base, a first resilient piece cantilevered from a first end of the base and a second resilient piece extending from a second end the base. The first pressing portion may be disposed on the first resilient piece and the second pressing portion may disposed on the second resilient piece. The leaf spring can sandwich the connection terminal and the mating terminal at a sufficient contact pressure. Further, the separation of the connection terminal and the mating terminal due to electromagnetic repulsion at the time of energization can be suppressed. Thus, arc discharge is not generated between the connection terminal and the mating terminal.

The spring may include an accommodating portion surrounded by the base, the first resilient piece and the second resilient piece. An opening may be provided at a position facing the base, and the mating terminal may be inserted into the accommodating portion through the opening. Accordingly, an insertion depth of the mating terminal can be limited by bringing an end of the mating terminal into contact with the base. Thus, the insertion depth of the mating terminal can be managed easily so that assembly of the connector can be improved.

The first pressing portion may project toward the second pressing portion from a surface of the first resilient piece facing the second resilient piece. Accordingly, the mating terminal can be inserted smoothly by sliding on the first pressing portion.

The second pressing portion may project toward the first pressing portion from a surface of the second resilient piece facing the first resilient piece. Accordingly, the connection terminal can be inserted smoothly by sliding on the second pressing portion.

The housing may include an inner housing holding the spring inside, an outer housing holding the inner housing inside and a holding cap for holding the inner housing in the outer housing. The insertion opening may be composed of an inner insertion opening provided in the inner housing and an outer insertion opening provided in the holding cap. Accordingly, the connection terminal can be mounted into the spring with the spring held in the inner housing, thereby facilitating a mounting operation of the connection terminal.

According to the connector disclosed by this specification, the terminal need not be processed into a tubular shape and the plate-like terminal can be used. Thus, the terminal can be manufactured easily even if the plate thickness of the terminal increases as a current becomes larger.

DETAILED DESCRIPTION

Figure 1:
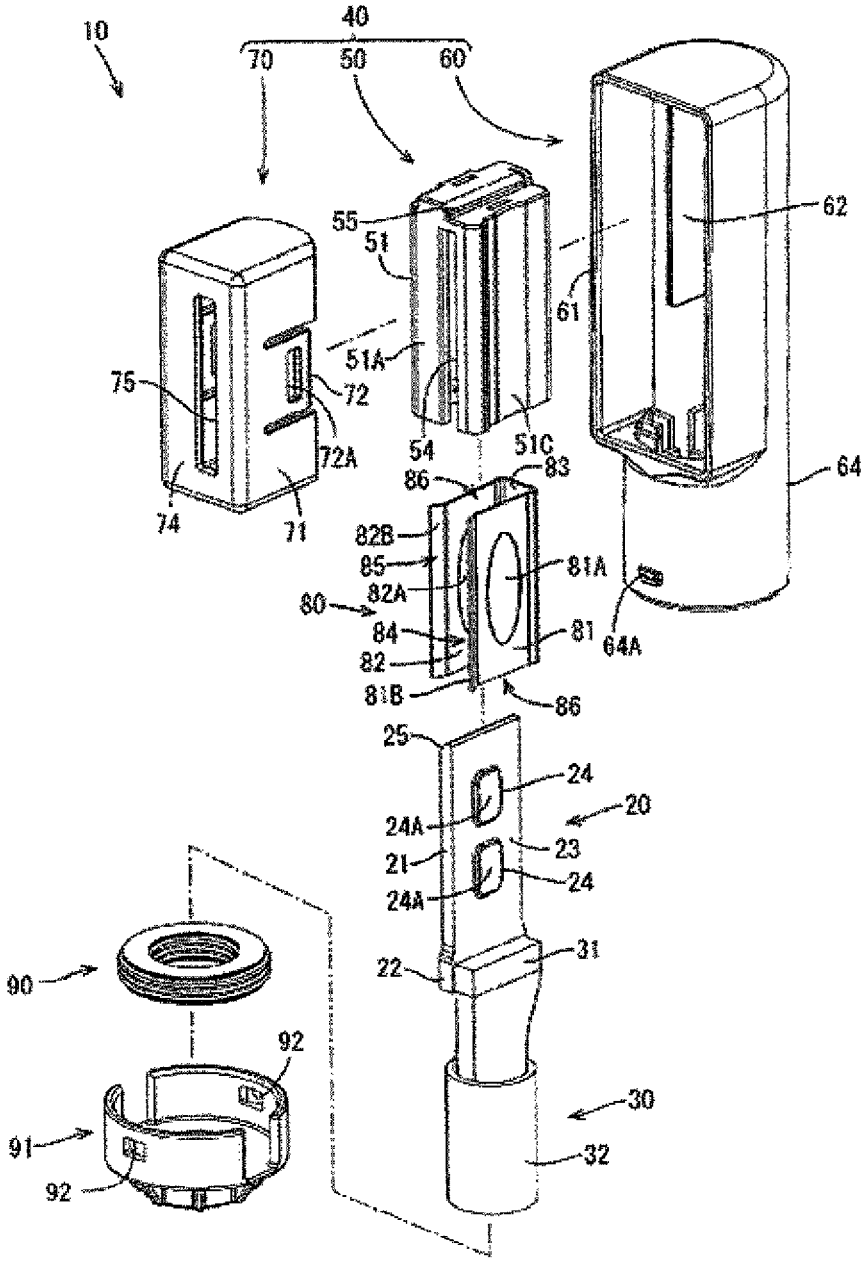
FIG. 1 is an exploded perspective view showing constituent components of a connector.
Figure 2:
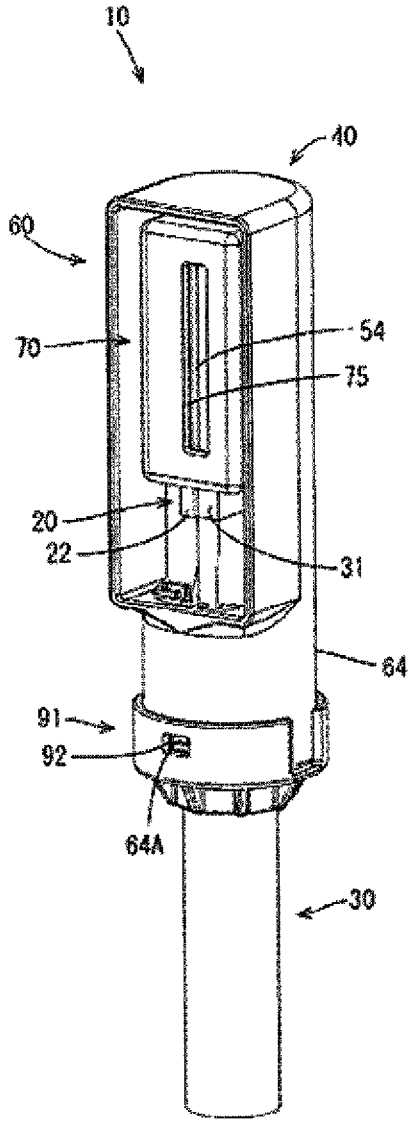
FIG. 2 is a perspective view of the connector.
Figure 3:
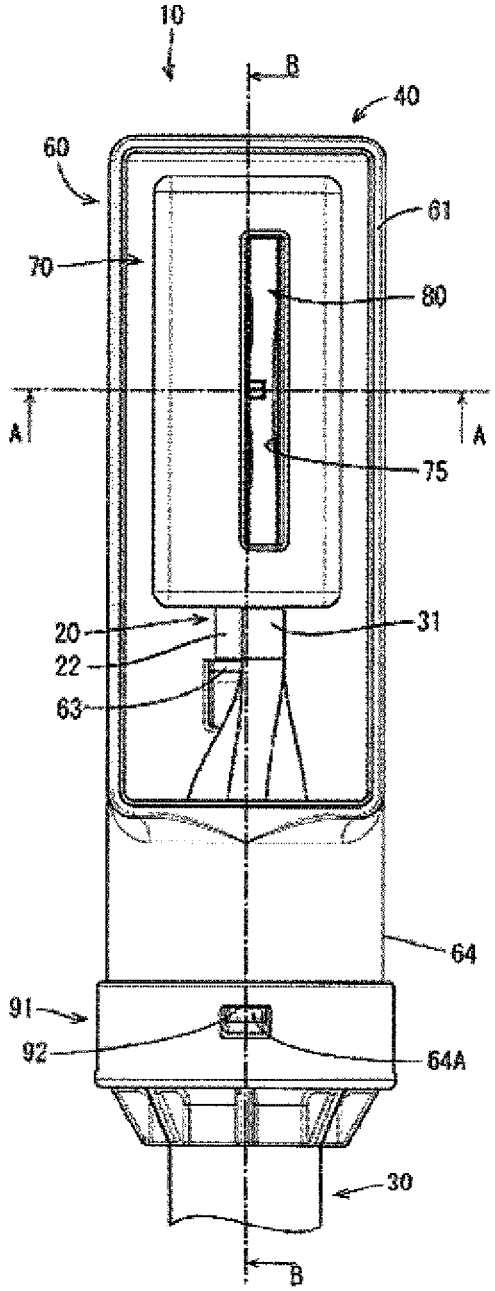
FIG. 3 is a front view of the connector.
Figure 4:
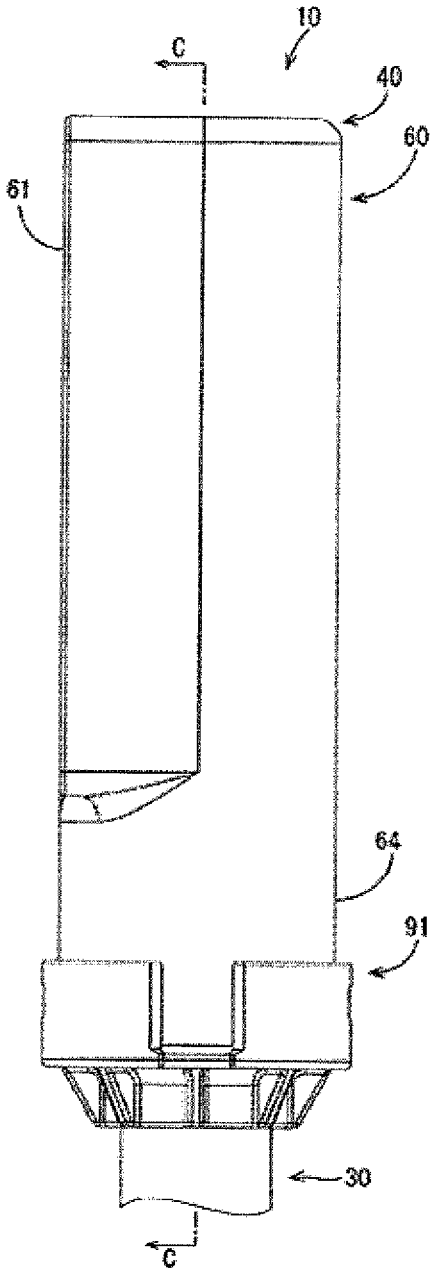
FIG. 4 is a side view of the connector.
Figure 6:
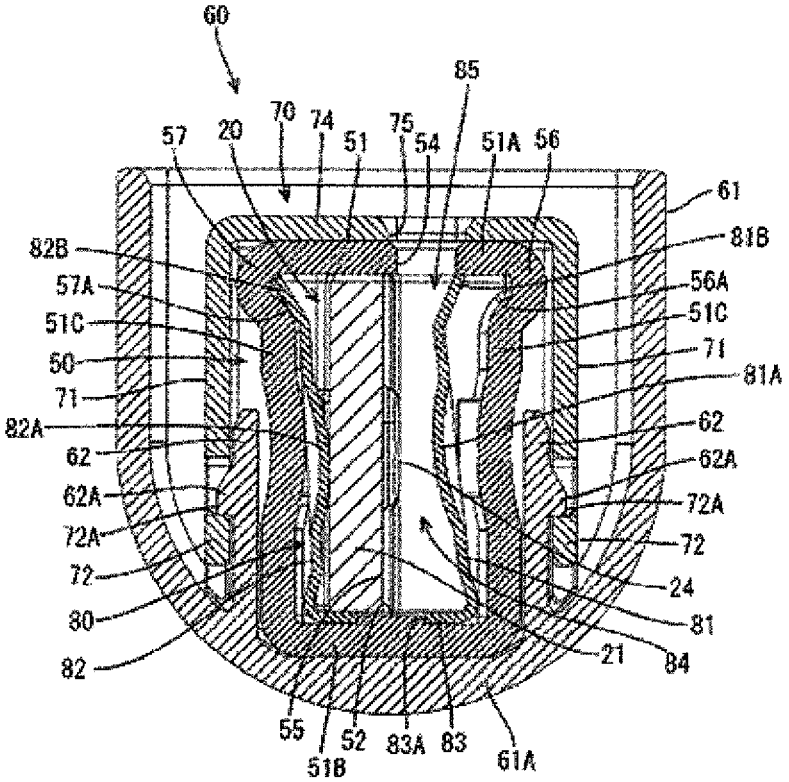
FIG. 6 is a section along A-A of FIG. 3 showing a state after the connection terminal is mounted into the spring portion.
Figure 7:
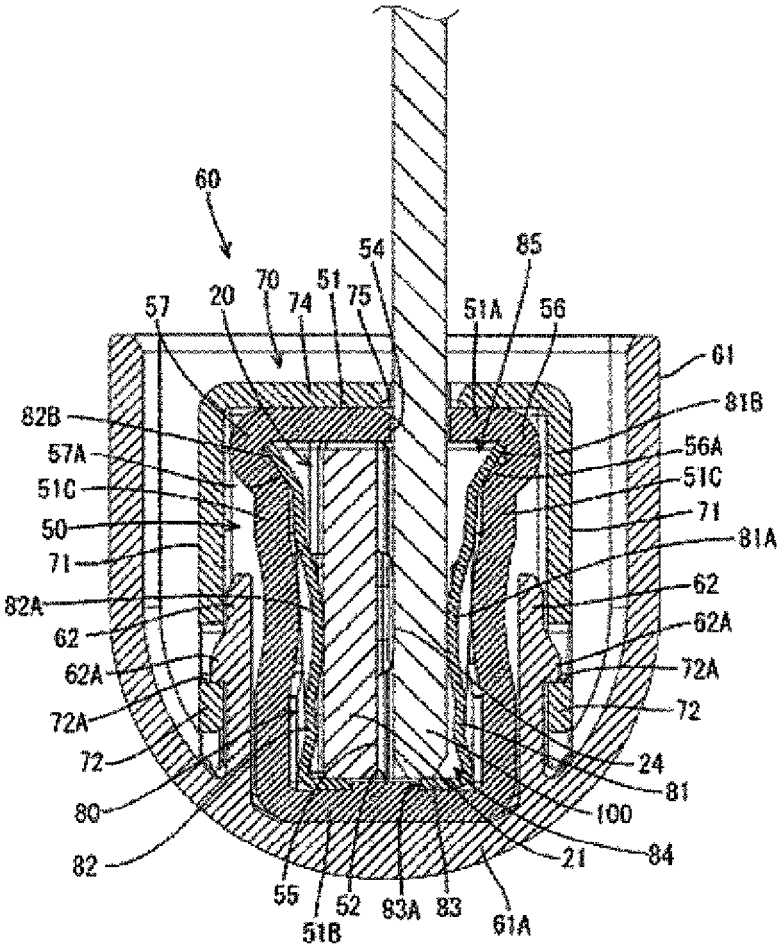
FIG. 7 is a section along A-A of FIG. 3 showing a state after a mating terminal is inserted.

An embodiment is described with reference to FIGS. 1 to 14. A connector 10 of this embodiment includes, as shown in FIG. 1, a connection terminal 20, a wire 30 welded to the connection terminal 20, a housing 40 into which the connection terminal 20 is mounted, a spring 80 to be held in the housing 40, a rubber ring 90 to be fit on the wire 30 and a back retainer 91 for holding the rubber ring 90. A mating terminal 100 shown in FIG. 7 is insertable into this connector 10. The housing 40 is composed of an inner housing 50, an outer housing 60 and a holding cap 70. The wire 30 is a coated wire in which a core 31 made of metal is covered with an insulating coating 32. The mating terminal 100 is a flat plate-like terminal made of metal. The mating terminal 100 is, for example, made of copper, copper alloy, aluminum, aluminum alloy or the like.

The connection terminal 20 is a flat plate-like terminal made of metal, such as copper, copper alloy, aluminum, aluminum alloy or the like. The connection terminal 20 has a rectangular shape in a plan view and includes a terminal connecting portion 21 to be connected to the mating terminal 100 and a wire connecting portion 22 to be welded to the core 31 of the wire 30. Contacts 24 project on a facing surface 23 of the terminal connecting portion 21 facing the mating terminal 100. Two of the contacts 24 are provided and disposed side by side in an arrangement direction of the terminal connecting portion 21 and the wire connecting portion 22. A tapered guiding surface 25 is provided on a tip part of the terminal connecting portion 21.

Figure 13:
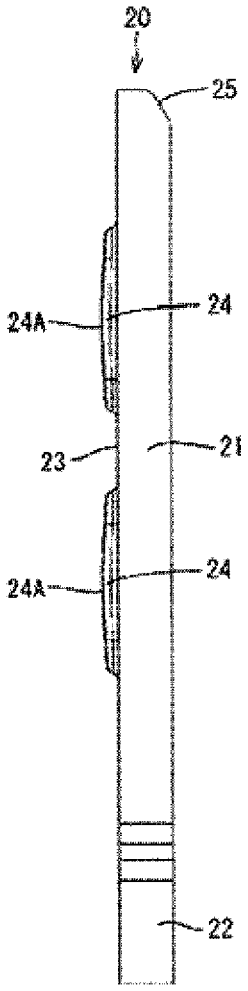
FIG. 13 is a side view of the connection terminal.
Figure 14:
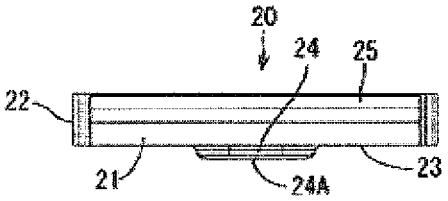
FIG. 14 is a plan view of the connection terminal.

As shown in FIGS. 13 and 14, each contact 24 has a contact surface 24A with a gentle spherical shape substantially close to a flat surface. For example, the contact surface 24A can be a dome-shape or arched convex surface. In a shown example, the contact 24 is a projection having a dome-shaped top surface. Note that a radius of curvature R of the contact surface 24A is, for example, 20 mm or more. Further, the contact surface 24 may be a part of the outer surface of an ideal true sphere or may be, for example, a part of the outer surface of a distorted sphere such as a spheroid. This contact surface 24A contacts the mating terminal 100 at one point so that a contact area with the mating terminal 100 is kept substantially constant even if the mating terminal 100 is twisted. Thus, high heat generation due to a sudden increase of contact resistance can be prevented. In other words, even if the mating terminal 100 is twisted, a sudden decrease in the contact area of the contact surface 24A and the mating terminal 100 can be suppressed. Thus, it is possible to suppress heat generation due to a sudden increase of contact resistance between the connection terminal 20 and the mating terminal 100 and to suppress damage of the terminals 20, 100 possibly caused by the heat generation. Further, since a connected state of the contact surface 24A and the mating terminal 100 is close to a connected state of flat surfaces, a contact pressure of the contact surface 24A and the mating terminal 100 is dispersed and abrasion due to repeated insertion and withdrawal of the mating terminal 100 easily is suppressed.

The spring 80 is a leaf spring made of metal, such as iron or iron alloy, e.g. made of SUS (Steel Use Stainless). Iron or iron alloy enables even a thin spring 80 to generate a strong spring force. The spring 80 includes a flat plate-like base 83, a first resilient piece 81 cantilevered from a first end of the base 83 and a second resilient piece 82 cantilevered from a second end of the base 83. The first and second resilient pieces 81, 82 are arranged to face each other. A tip part of the first resilient piece 81 is bent toward a side opposite to the second resilient piece 82 and a part from that bent edge to a tip serves as a first guide 81B. Similarly, a tip part of the second resilient piece 82 is bent toward a side opposite to the first resilient piece 81 and a part from that bent edge to a tip serves as a second guide 82B.

Figure 12:
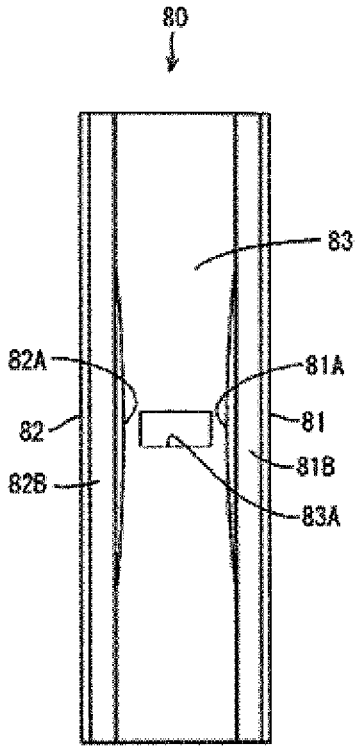
FIG. 12 is a front view of the spring portion.

As shown in FIG. 12, the base 83 of the spring 80 is formed into a rectangular shape long in a vertical direction. A rectangular holding hole 83A long in a lateral direction penetrates through a central part of the base 83.

A space in the spring 80 surrounded by the base 83 and the first and second resilient pieces 81, 82 functions as an accommodating portion 84. A first opening 85 is formed on a side of the spring 80 opposite to the base 83. In an example shown in FIG. 1, the first opening 85 is formed between the tip edge, which can be a long side, of the first resilient piece 81 and the tip edge, which can be a long side, of the second resilient piece 82.

As shown in FIG. 1, second openings 86 are formed between the upper end edge, which can be a short side, of the first resilient piece 81 and the upper end edge, which can be a short side, of the second resilient piece 82 and between the lower end edge, which can be a short side, of the first resilient piece 81 and the lower end edge, which can be a short side, of the second resilient piece 82.

First and second pressing portions 81A and 82A project toward one another from opposed facing surfaces of the respective first and second resilient pieces 81 and 82. A surface of each pressing portion 81A, 82A is formed into a gentle spherical surface substantially close to a flat surface. Further, each pressing portion 81A, 82A is formed into an elliptical shape long in the vertical direction in a side view as shown in FIG. 1.

Figure 5:
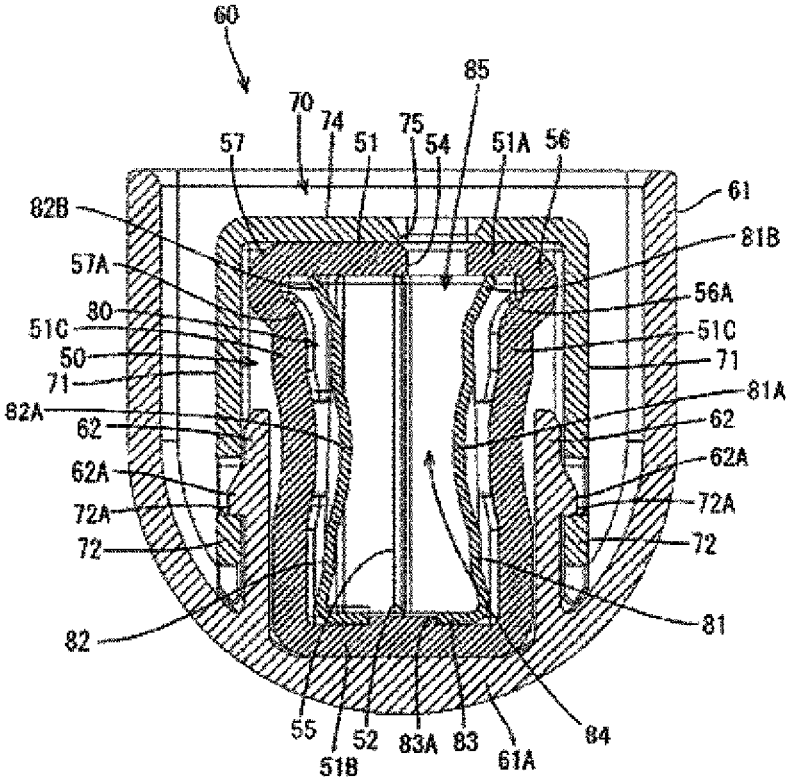
FIG. 5 is a section along A-A of FIG. 3 showing a state before a connection terminal is mounted into a spring portion.

As shown in FIG. 5, the spring 80 is accommodated inside the inner housing 50. The inner housing 50 is made of synthetic resin and, as shown in FIG. 1, includes a receptacle 51 open downward. The spring 80 is inserted into the receptacle 51 from below. The receptacle 51 includes a peripheral wall composed of a front wall 51A, a rear wall 51B and two side walls 51C. The front wall 51A of the receptacle 51 is provided with a forwardly and downwardly open inner insertion opening 54 long in the vertical direction.

Figure 11:
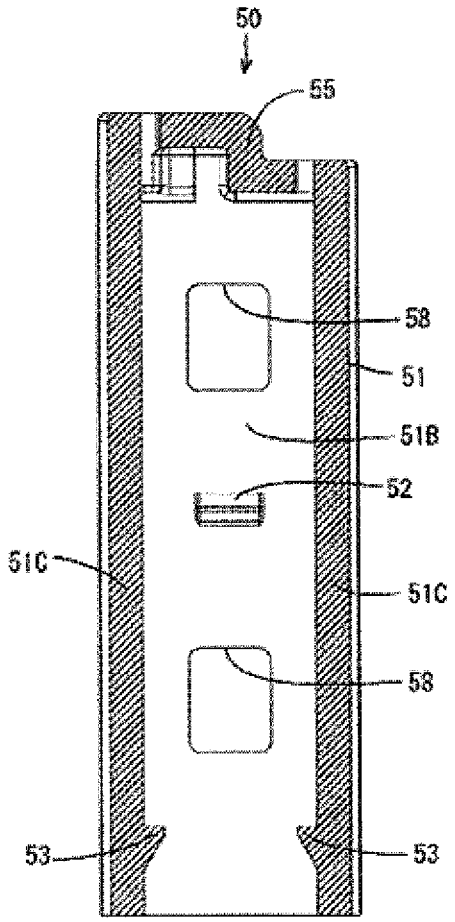
FIG. 11 is a front view in section showing an internal structure of an inner housing.

As shown in FIG. 11, the rear wall 51B of the receptacle 51 is provided with a first holding projection 52. On the other hand, the base 83 of the spring 80 is provided with a holding hole 83A. If the spring 80 is inserted into the receptacle 51, the first holding projection 52 is fit into the holding hole 83A and the inner peripheral edge of the holding hole 83 is locked to the first holding projection 52, as shown in FIG. 5, to hold the spring 80 in the receptacle 51.

Figure 9:
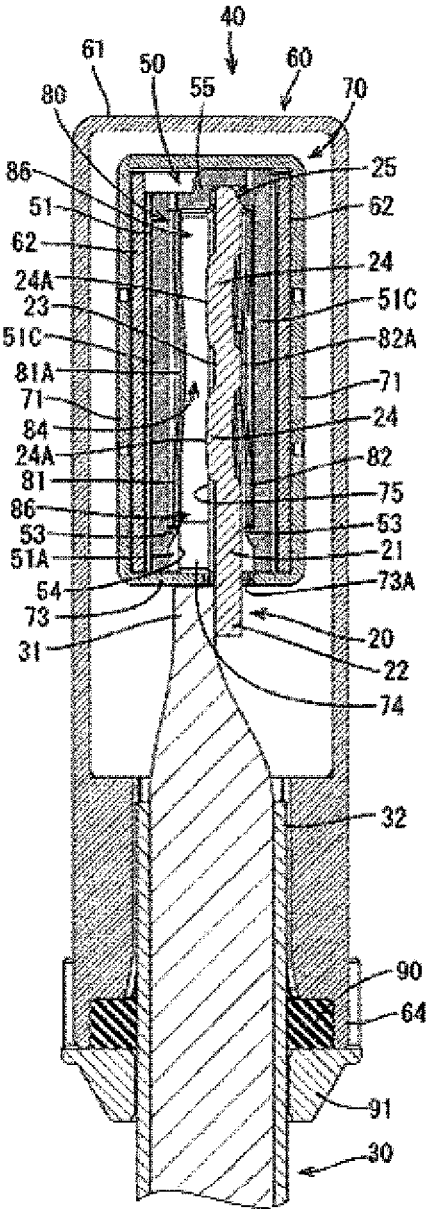
FIG. 9 is a section along C-C of FIG. 4.

Further, as shown in FIG. 11, the side walls 51C of the receptacle 51 are provided with a pair of second holding projections 53. The second holding projections 53 are disposed below the first holding projection 52 and are located near an opening of the receptacle 51. As shown in FIG. 9, the spring 80 is held in the receptacle 51 also by lower end parts of the respective resilient pieces 81, 82 of the spring 80 being locked to the second holding projections 53.

Figure 10:
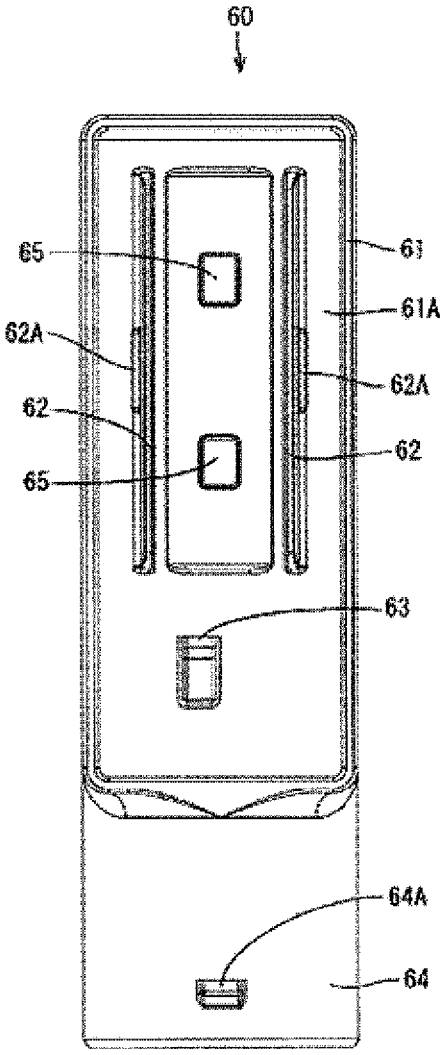
FIG. 10 is a front view of an outer housing.

The outer housing 60 is made of synthetic resin. As shown in FIGS. 1 and 10, the outer housing 60 includes a forwardly open receptacle 61. Two mounting walls 62 project forward from a back wall 61A of the receptacle 61 and are arranged to face in the lateral direction. Mounting projections 62A are provided on outer peripheral sides of the mounting walls 62. The inner housing 50 is accommodated between the mounting walls 62 and is held by the holding cap 70.

Figure 8:
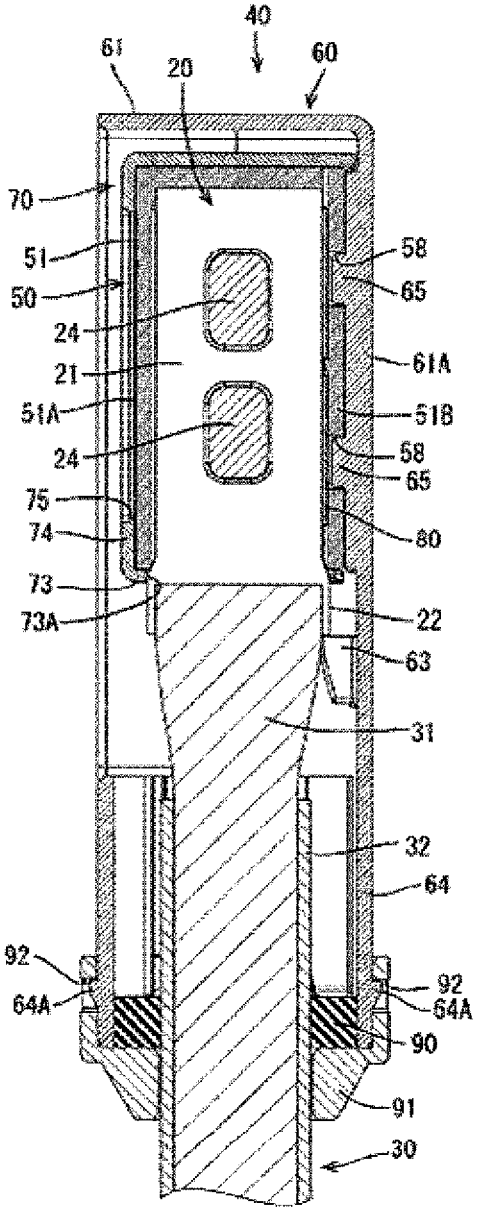
FIG. 8 is a section along B-B of FIG. 3.

The outer housing 60 includes a rubber ring mounting tube 64 into which the rubber ring 90 is mounted. As shown in FIG. 8, the rubber ring 90 is mounted into the rubber ring mounting tube 64 from below and is sandwiched between the outer peripheral surface of the wire W and the inner peripheral surface of the rubber ring mounting tube 64 to suppress the intrusion of water into the rubber ring mounting tube 64 from below. The back retainer 91 is mounted below the rubber ring 90 and is provided with two mounting recesses 92. The back retainer 91 is held in the rubber ring mounting tube 64 by locking the mounting recesses 92 to the mounting projections 64A. The rubber ring 90 is held retained in the rubber ring mounting tube 64 by the back retainer 91.

The holding cap 70 is made of synthetic resin and, as shown in FIG. 1, is open rearward (rightward in FIG. 1). Both side walls 71 of the holding cap 70 are provided with mounting pieces 72. Each mounting piece 72 is cantilevered rearward from a front end part of the side wall 71. A mounting hole 72A is provided in a tip part of the mounting piece 72. If the holding cap 70 is fit externally on the mounting walls 62, the mounting projections 62A are fit into the mounting holes 72A. Thus, the holding cap 70 is held on the mounting walls 62 by the inner peripheral edges of the mounting holes 72A being locked to the mounting projections 62A. In this way, the inner housing 50 accommodated inside the holding cap 70 is held in the outer housing 60.

As shown in FIG. 10, upper and lower positioning protrusions 65 are provided between the mounting walls 62 on the back wall 61A of the receptacle 61 of the outer housing 60. On the other hand, as shown in FIG. 8, upper and lower positioning holes 58 are provided in the rear wall 51B of the receptacle 51 of the inner housing 50. Each positioning protrusion 65 is fit into each positioning hole 58 from behind. In this way, the inner housing 50 is positioned in a proper mounting posture with respect to the outer housing 60.

A front wall 74 of the holding cap 70 is provided with an outer insertion opening 75. The outer insertion opening 75 is an opening through which the mating terminal 100 is inserted, and is arranged side by side with the inner insertion opening 54 of the inner housing 50 in a front-rear direction, as shown in FIG. 5. Thus, the mating terminal 100 enters the spring 80 through the outer insertion opening 75 of the holding cap 70 and the inner insertion opening 54 of the inner housing 50.

Further, a bottom wall 73 of the holding cap 70 is provided with a terminal insertion hole 73A. The connection terminal 20 is inserted through the terminal insertion hole 73A from below, thereby causing a side edge part of the wire connecting portion 22 to be locked to a retaining projection 63 of the outer housing 60. Therefore, the connection terminal 20 is retained by the outer housing 60 and held between the resilient pieces 81, 82 of the spring 80.

The spring 80 sandwiches the mating terminal 100 between the connection terminal 20 and the spring 80 to suppress the sliding wear of the connection terminal 20 and the mating terminal 100 when the wire 30 is shaken. The connection terminal 20 is mounted into the spring 80 from a state shown in FIG. 5, thereby causing the connection terminal 20 to slide on the second pressing portion 82A of the second resilient piece 82, as shown in FIG. 6. More particularly, the connection terminal 20 is inserted into the accommodating portion 84 of the spring 80 through the second opening 86, thereby causing the connection terminal 20 to slide on the second pressing portion 82A of the second resilient piece 82. In this way, the connection terminal 20 can be inserted smoothly into the spring 80 toward a proper mount position. Note that, as shown in FIG. 9, the tip of the connection terminal 20 is locked to a step 55 provided on the rear wall 51B of the inner housing 50. Thus, a leftward displacement of the entire connection terminal 20 by receiving a reaction force from the spring 80 is suppressed. Therefore, the closing of at least a part of the inner insertion opening 54 by the connection terminal 20 can be suppressed, and unpreferable situations, such as one in which the mating terminal 100 is not guided into the spring 80, can be suppressed.

However, as shown in FIG. 6, the spring 80 is inclined by the connection terminal 20. Thus, the second resilient piece 82 interferes with the side wall 51C of the inner housing 50 to limit inclination of the spring 80. More particularly, the tip of the second resilient piece 82 interferes with a second escaping recess 57 to be described later to limit inclination of the spring 80. In this way, the tip of the first guide 81B of the first resilient piece 81 will not protrude from the inner insertion opening 54 of the inner housing 50. Therefore, the mating terminal 100 does not interfere with the tip of the first resilient piece 81 and is guided into the spring 80 by the first guide 81B.

Further, if the spring 80 is inclined, an engagement margin of the tip of the first resilient piece 81 and the second holding projection 53 becomes smaller as shown in FIG. 9. However, as shown in FIG. 6, the base 83 is hardly inclined even if the first resilient piece 81 is inclined. Thus, the first holding projection 52 remains fit in the holding hole 83A so that the spring 80 does not detach from the inner housing 50.

Subsequently, from a state shown in FIG. 6, the mating terminal 100 enters the inner housing 50 through the outer insertion opening 75 and the inner insertion opening 54. More particularly, the mating terminal 100 is guided through the first opening 85 and into the accommodating portion 84 of the spring 80 by sliding on the first guide 81B of the first resilient piece 81.

The tip of the mating terminal 100 starts to slide on the first pressing portion 81A of the first resilient piece 81 and causes the first resilient piece 81 to start deforming resiliently in a direction away from the second resilient piece 82. The first and second resilient pieces 81, 82 of the spring 80 are in a most open state when the mating terminal 100 reaches the proper insertion position shown in FIG. 7 and generate a strong spring force.

The mating terminal 100 is sandwiched by the spring portion 80 to cross the connection terminal 20. More particularly, with the mating terminal 100 and the connection terminal 20 overlapped to have an overlapping part, the spring 80 is configured to resiliently press the overlapping part of the mating terminal 100 and the connection terminal 20 in a plate thickness direction. In the shown example, the mating terminal 100 is sandwiched by the spring 80 to orthogonally cross the connection terminal 20. In other words, the mating terminal 100 is overlapped to cross the connection terminal 20 inside the accommodating portion 84. By arranging the connection terminal 20 and the mating terminal 100 orthogonal to each other, required dimensions of the connector 10 and the mating terminal 100 in a longitudinal direction (vertical direction of FIG. 1) of the connection terminal 20 can be reduced, for example, as compared to the case where the connection terminal 20 and the mating terminal 100 are arranged in a straight line.

The mating terminal 100 is pressed toward the connection terminal 20 by the first pressing portion 81A, and the connection terminal 20 is pressed toward the mating terminal 100 by the second pressing portion 82A. The first and second pressing portions 81A, 82A are arranged so that pressing directions are opposite. More particularly, the first and second pressing portions 81A, 82A bilaterally symmetrically overlap in the pressing directions so that the mating terminal 100 and the connection terminal 20 are sandwiched by the first and second pressing portions 81A, 82A. Therefore, the contacts 24 of the connection terminal 20 are in contact with the mating terminal 100 at a high contact pressure and the terminals are connected conductively. In this contact state, even if the wire 30 is shaken, the contacts 24 do not slide on the mating terminal 100 to be worn.

Note that a first escaping recess 56 for allowing the tip of the first resilient piece 81 to escape and the second escaping recess 57 for allowing the tip of the second resilient piece 82 to escape are provided on corners between the front wall 51A and the side walls 51C of the inner housing 50. Further, a first excessive deflection preventing portion 56A for receiving the first guide 81B is provided behind the first escaping recess 56, and a second excessive deflection preventing portion 57A for receiving the second guide 82B is provided behind the second escaping recess 57. Even if the mating terminal 100 is inserted in an oblique posture, excessive deflection of the first resilient piece 81 is prevented by the first excessive deflection preventing portion 56A. Further, even if the connection terminal 20 is inserted in an oblique posture, excessive deflection of the second resilient piece 82 is prevented by the second excessive deflection preventing portion 57A.

As described above, in this embodiment, if the mating terminal 100 is inserted into the insertion opening (inner and outer insertion openings 54, 75) of the housing 40, the connection terminal 20 and the mating terminal 100 are electrically connected while being sandwiched by the spring 80 held in the housing 40.

By doing so, the terminal need not be processed into a tubular shape. Thus, the terminal can be manufactured easily even if the plate thickness of the terminal increases.

Further, the connection terminal 20 may be provided with the contacts 24 projecting on the facing surface 23 facing the mating terminal 100, and the contacts 24 may have the spherical contact surfaces 24A. According to this configuration, even if the mating terminal 100 is twisted, the contact areas of the contact surfaces 24A and the mating terminal 100 will not suddenly decrease. Therefore, contact resistance between the connection terminal 20 and the mating terminal 100 will not suddenly increases to generate heat and damage the terminals 20, 100.

The spring 80 includes the first pressing portion 81A for pressing the mating terminal 100 toward the connection terminal 20 and the second pressing portion 82A for pressing the connection terminal 20 toward the mating terminal 100. According to this configuration, the connection terminal 20 and the mating terminal 100 are sandwiched by the first and second pressing portions 81A, 82A. Thus, the connection terminal 20 and the mating terminal 100 are in contact at a high contact pressure and electrically connected. Therefore, the contacts 24 of the connection terminal 20 will not slide on the mating terminal 100 to be worn.

Further, if the connection terminal 20 and the mating terminal 100 are energized, an electromagnetic repulsive force based on a Coulomb force is applied to the connection terminal 20 and the mating terminal 100. If the connection terminal 20 and the mating terminal 100 are displaced in directions away from each other by electromagnetic repulsion, contact resistance may increase due to a reduction in the contact area of the terminals 20, 100. However, according to the above configuration, the first pressing portion 81A presses the mating terminal 100 toward the connection terminal 20. Further, the second pressing portion 82A presses the connection terminal 20 toward the mating terminal 100. Specifically, resilient forces are applied to both terminals 20, 100 from the spring 80 to suppress the separation of the terminals 20, 100 against the electromagnetic repulsive force. Therefore, contact resistance of the connection terminal 20 and the mating terminal 100 will not increase due to electromagnetic repulsion at the time of energization.

The spring 80 may be a leaf spring made of metal and include the plate-like base 83, the first resilient piece 81 cantilevered from the first end of the base 83 and the second resilient piece 82 cantilevered from the second end of the base 83. The first pressing portion 81A may be disposed on the first resilient piece 81, and the second pressing portion 82A may be disposed on the second resilient piece 82. According to this configuration, the first pressing portion 81A provided on the first resilient piece 81 of the spring 80 in the form of a leaf spring presses the mating terminal 100 toward the connection terminal 20. Further, the second pressing portion 82A provided on the second resilient piece 82 presses the connection terminal 20 toward the mating terminal 100. Thus, the connection terminal 20 and the mating terminal 100 can be sandwiched at a higher contact pressure so that electrical connection reliability of the connection terminal 20 and the mating terminal 100 can be improved.

Further, as described above, the connection terminal 20 and the mating terminal 100 try to be separated from each other due to the electromagnetic repulsive force generated at the time of energization. Thus, there is a concern for an increase of contact resistance due to a reduction in the contact area of the terminals 20, 100. However, according to the above configuration, since the connection terminal 20 and the mating terminal 100 are sandwiched by the spring 80, an increase of contact resistance between the connection terminal 20 and the mating terminal 10 at the time of energization can be suppressed.

Further, according to the above configuration, the connection terminal 20 and the mating terminal 100 are connected electrically via the spring 80. Specifically, the connection terminal 20 and the mating terminal 100 are connected electrically via the first resilient piece 81, the base 83 and the second resilient piece 82. Therefore, even if the contact pressure between the terminals 20 and 100 decreases to increase the contact resistance due to the electromagnetic repulsion at the time of energization, heat generation between the terminals 20 and 100 can be suppressed since the connection terminal 20 and the mating terminal 100 are electrically connected via the spring 80.

Further, as described above, the connection terminal 20 and the mating terminal 100 try to be separated from each other due to the electromagnetic repulsive force generated at the time of energization. Thus, there is a concern that arc discharge is generated between the terminals 20 and 100 to damage the terminals 20, 100, for example, because a clearance is formed between the connection terminal 20 and the mating terminal 100 and an electrically connected state of the terminals 20, 100 is released. However, according to the above configuration, even if the clearance is formed between the connection terminal 20 and the mating terminal 100 due to the electromagnetic repulsion at the time of energization, the state where the connection terminal 20 and the mating terminal 100 are connected electrically via the spring 80 is maintained. Thus, arc discharge is not generated between the connection terminal 20 and the mating terminal 100 due to the electromagnetic repulsion at the time of energization. Therefore, the connection terminal 20 and the mating terminal 100 are not damaged to increase the contact resistance between the terminals 20 and 100.

The spring 80 includes the first opening 85 on the side opposite to the base 83 and the mating terminal 100 is inserted into the accommodating portion 84 through the first opening 85. According to this configuration, in inserting the mating terminal 100 into the accommodating portion 84, an insertion depth of the mating terminal 100 can be limited by bringing an end of the mating terminal 100 into contact with the base 83. Thus, the insertion depth of the mating terminal 100 can be managed easily, Therefore the operability of electrical connection of the connection terminal 20 and the mating terminal 100 can be improved.

The first pressing portion 81A may project toward the second pressing portion 82A from the surface of the first resilient piece 81 facing the second resilient piece 82. According to this configuration, in inserting the mating terminal 100 into the connector 10, the mating terminal 100 can be inserted smoothly by sliding on the first pressing portion 81A.

The second pressing portion 82A may be provided to project toward the first pressing portion 81A from the surface of the second resilient piece 82 facing the first resilient piece 81. According to this configuration, in inserting the connection terminal 20 into the spring 80, the connection terminal 20 can be inserted smoothly by sliding on the second pressing portion 82A.

The housing 40 may include the inner housing 50 holding the spring 80 inside, the outer housing 60 holding the inner housing 50 inside and the holding cap 70 for holding the inner housing 50 in the outer housing 60. The insertion opening may be composed of the inner insertion opening 54 provided in the inner housing 50 and the outer insertion opening 75 provided in the holding cap 70. By doing so, the connection terminal 20 can be mounted into the spring 80 with the spring 80 held in the inner housing 50. Therefore a mounting operation of the connection terminal 20 is facilitated.

The technique disclosed by this specification is not limited to the above described and illustrated embodiment. For example, the following various modes are also included.

Although the first and second pressing portions 81A, 82A are bilaterally symmetrically arranged to overlap in the pressing directions in the above embodiment, these need not necessarily be bilaterally symmetrically arranged. First and second pressing portions may be arranged to partially overlap in pressing directions or may be arranged not to overlap in the pressing directions.

Although the spring 80 made of SUS is illustrated in the above embodiment, a spring may be made of metal other than SUS. The spring 80 may be made of carbon steel or the like as another example of iron alloy. More particularly, the spring 80 may be made of ribbon steel or the like. The spring 80 may be made of copper, copper alloy or the like. The spring 80 made of copper or copper alloy has better electrical conduction than the spring 80 made of iron or iron alloy. Therefore, even if a clearance is formed between the terminals 20 and 100 due to electromagnetic repulsion in the configuration in which the connection terminal 20 and the mating terminal 100 are connected electrically via the spring 80, arc discharge generated between the terminals 20 and 100 can be suppressed.

Although the spring 80 formed of a leaf spring is illustrated in the above embodiment, a spring portion formed of a coil spring may be used.

Although the first pressing portion 81A having a spherical surface is illustrated in the above embodiment, a surface of a first pressing portion may be flush with a surface of the first resilient piece 81.

Although the second pressing portion 82A having a spherical surface is illustrated in the above embodiment, a surface of a second pressing portion may be flush with a surface of the second resilient piece 82.

Although the inner housing 50 and the holding cap 70 are separately configured in the above embodiment, an inner housing and a holding cap may be integral. In this case, a single insertion opening integrally configured with the inner insertion opening 54 and the outer insertion opening 75 may be provided.

Although the contacts 24 are provided on the facing surface 23 facing the mating terminal 100 in the above embodiment, contacts may be provided on the mating terminal 100.

Although the connection terminal 20 and the mating terminal 100 are arranged to orthogonally cross in the above embodiment, there is no limitation to this. For example, the connection terminal 20 and the mating terminal 100 may be arranged side by side in a straight line. According to this configuration, required dimensions of the connector 10 and the mating terminal 100 in a direction (lateral direction of FIG. 1) orthogonal to the longitudinal direction of the connection terminal 20 can be reduced as compared to the case where the connection terminal 20 and the mating terminal 100 orthogonally cross. In this case, the inner insertion opening 54 and the outer insertion opening 75 may be provided to overlap the second openings 86 so that the connection terminal 20 and the mating terminal 100 can be inserted into the spring portion 80 through the second openings 86.

Although the two contacts 24 are provided on the facing surface 23 of the connection terminal 20 in the above embodiment, there is no limitation to this. For example, one, three or more contacts 24 may be provided on the facing surface 23 of the connection terminal 20.

LIST OF REFERENCE SIGNS

10 . . . connector
20 . . . connection terminal
23 . . . facing surface
24 . . . contact
40 . . . housing
50 . . . inner housing
54 . . . inner insertion opening
60 . . . outer housing
70 . . . holding cap
75 . . . outer insertion opening
80 . . . spring
81 . . . first resilient piece
81A . . . first pressing portion
82 . . . second resilient piece
82A . . . second pressing portion
83 . . . base
100 . . . mating terminal

The invention claimed is:

1. A connector into which a plate-like mating terminal is insertable, comprising:

a plate-like connection terminal;

a spring; and a housing including an insertion opening into which the mating terminal is inserted, the spring being held in the housing, the mating terminal inserted into the insertion opening and the connection terminal being sandwiched by the spring, wherein the housing includes an inner housing holding the spring inside, an outer housing holding the inner housing inside and a holding cap for holding the inner housing in the outer housing, and the insertion opening is composed of an inner insertion opening provided in the inner housing and an outer insertion opening provided in the holding cap.

2. The connector of claim 1, wherein:

the connection terminal includes a contact formed to project on a surface facing the mating terminal, and the contact has a spherical contact surface.

3. The connector of claim 2, wherein:

the spring includes a first pressing portion for pressing the mating terminal toward the connection terminal and a second pressing portion for pressing the connection terminal toward the mating terminal, and the mating terminal inserted into the insertion opening and the connection terminal are sandwiched by the first and second pressing portions.

4. The connector of claim 3, wherein the spring is a leaf spring made metal and includes a plate-like base, a first resilient piece cantilevered from a first end of the base and a second resilient piece extending from second end of the base, the first pressing portion is disposed on the first resilient piece and the second pressing portion is disposed on the second resilient piece.

5. The connector of claim 4, wherein:

the spring includes an accommodating portion surrounded by the base, the first resilient piece and the second resilient piece, and an opening is provided at a position facing the base, and the mating terminal is inserted into the accommodating portion through the opening.

6. The connector of claim 4, wherein the first pressing portion projects toward the second pressing portion from a surface of the first resilient piece facing the second resilient piece.

7. The connector of claim 4, wherein the second pressing portion projects toward the first pressing portion from a surface of the second resilient piece facing the first resilient piece.

8. The connector of claim 1, wherein:

the spring includes a first pressing portion for pressing the mating terminal toward the connection terminal and a second pressing portion for pressing the connection terminal toward the mating terminal, and the mating terminal inserted into the insertion opening and the connection terminal are sandwiched by the first and second pressing portions.

9. The connector of claim 8, wherein the spring is a leaf spring made metal and includes a plate-like base, a first resilient piece cantilevered from a first end of the base and a second resilient piece extending from a second end of the base, the first pressing portion is disposed on the first resilient piece and the second pressing portion is disposed on the second resilient piece.

10. The connector of claim 9, wherein:

the spring includes an accommodating portion surrounded by the base, the first resilient piece and the second resilient piece, and an opening is provided at a position facing the base, and the mating terminal is inserted into the accommodating portion through the opening.

11. The connector of claim 9, wherein the first pressing portion projects toward the second pressing portion from a surface of the first resilient piece facing the second resilient piece.

12. The connector of claim 9, wherein the second pressing portion projects toward the first pressing portion from a surface of the second resilient piece facing the first resilient piece.

* * * * *